US006614401B2

(12) United States Patent
Onaka et al.

(10) Patent No.: US 6,614,401 B2
(45) Date of Patent: Sep. 2, 2003

(54) ANTENNA-ELECTRODE STRUCTURE AND COMMUNICATION APPARATUS HAVING THE SAME

(75) Inventors: Kengo Onaka, Yokohama (JP); Shoji Nagumo, Kawasaki (JP); Takashi Ishihara, Machida (JP); Jin Sato, Sagamihara (JP); Akira Miyata, Yokohama (JP); Kazunari Kawahata, Machida (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/096,587

(22) Filed: Mar. 14, 2002

(65) Prior Publication Data

US 2002/0140610 A1 Oct. 3, 2002

(30) Foreign Application Priority Data

Apr. 2, 2001 (JP) ..... 2001-103460

(51) Int. Cl.[7] ..... H01Q 1/38
(52) U.S. Cl. ..... 343/702; 343/846
(58) Field of Search ..... 343/702, 700 MS, 343/846; 455/575

(56) References Cited

U.S. PATENT DOCUMENTS 5,696,517 A * 12/1997 Kawahata et al. ..... 343/702
6,323,811 B1 * 11/2001 Tsubaki et al. ..... 343/702

FOREIGN PATENT DOCUMENTS

JP 11-251815 11/2002

* cited by examiner

*Primary Examiner*—Michael C. Wimer
(74) *Attorney, Agent, or Firm*—Keating & Bennett, LLP

(57) ABSTRACT

An antenna-electrode structure includes a feeding radiant-electrode and a grounded portion arranged such that an open-end of the feeding radiant-electrode defines a capacitance to the grounded portion therebetween, and a non-feeding radiant-electrode arranged to electromagnetically couple the feeding radiant-electrode. The non-feeding radiant electrode is arranged such that an open-end thereof defines a capacitance to the grounded portion therebetween to produce a dual-frequency resonance state together with the feeding radiant-electrode. In response to a signal supplied from a signal-supply source, the feeding radiant-electrode performs an antenna action and the non-feeding radiant-electrode in turn performs an antenna action by signal transmission from the feeding radiant-electrode, such that by being excited from these actions, the grounded portion also performs an antenna action. Because of the antenna action of the grounded portion, the sizes of the feeding radiant-electrode and the non-feeding radiant electrode are reduced.

21 Claims, 11 Drawing Sheets

(Upper Side)

(Lower Side)

ANTENNA-ELECTRODE STRUCTURE AND COMMUNICATION APPARATUS HAVING THE SAME

BACKGROUND OF THE INVENTION

1. Field of the Invention

The present invention relates to a communication apparatus such as a portable telephone and an antenna-electrode structure provided in the communication apparatus.

2. Description of the Related Art

Recently, the size communication apparatuses, such as portable telephones have been decreasing rapidly. In association with such miniaturization of communication apparatuses, a built-in antenna is required to further reduce the size of the communication apparatus.

However, when the size of an antenna is reduced, the frequency bandwidth of electric waves transmitted and received by the antenna is reduced. Antennas having various structures are proposed to obtain a miniaturized antenna having an increased bandwidth. However, an antenna has not yet been produced in which miniaturization, increased bandwidth and a simplified structure are achieved.

SUMMARY OF THE INVENTION

In order to overcome the above-described problems, preferred embodiments of the present invention provide an antenna-electrode structure and a communication apparatus including the antenna-electrode structure in which miniaturization, increased bandwidth and a simplified structure are achieved.

An antenna-electrode structure according to preferred embodiments of the present invention includes a substrate, a grounded portion provided on the substrate, a non-grounded portion on which an antenna is mounted, a feeding radiant-electrode into which a signal is supplied from a signal supply source, a non-feeding radiant-electrode provided adjacent to the feeding radiant electrode and spaced from the grounded portion via a spacing therebetween for producing a dual-frequency resonance state by electromagnetic coupling with the feeding radiant-electrode, and a dielectric base substance surface-mounted on the substrate and having the feeding radiant-electrode mounted thereon in a substantially U-shaped configuration, wherein one end of the feeding radiant-electrode is open so as to produce a capacitance to the grounded portion therebetween, and wherein the non-feeding radiant-electrode is provided on the dielectric base substance in a substantially L-shaped configuration along the feeding radiant-electrode and one end of the non-feeding radiant-electrode is connected to the grounded portion while the other end is open, the open end of the non-feeding radiant electrode is a capacity-loaded electrode defining a capacitance to the grounded portion therebetween at a position close to a capacity portion provided between the open-end of the feeding radiant-electrode and the grounded portion.

Preferably, the antenna-electrode structure further includes an insulating member, wherein the feeding radiant-electrode and the non-feeding radiant-electrode are arranged with the insulating member provided therebetween.

Preferably, the feeding radiant-electrode and the non-feeding radiant-electrode are provided directly on the non-grounded portion on the substrate by pattern forming, instead of forming the feeding radiant-electrode and the non-feeding radiant-electrode on the dielectric base substance.

Preferably, the antenna-electrode structure further includes a feeding electrode electrically connected to the signal supply source, wherein the feeding radiant-electrode communicates and connects to the feeding electrode so as to define a direct-feeding-type feeding radiant-electrode in which a signal is directly supplied from the signal supply source via the feeding electrode.

Preferably, the antenna-electrode structure further includes a feeding electrode that is electrically connected to the signal supply source, wherein the feeding radiant-electrode is arranged at a position that is spaced from the feeding electrode so as to define a capacity-feeding-type feeding radiant-electrode in which a signal from the signal supply source is supplied by capacitively coupling from the feeding electrode.

A communication apparatus according to preferred embodiments of the present invention includes an antenna-electrode structure according to one of the configurations described above.

According to preferred embodiments of the present invention having the configurations described above, when a signal is supplied to the feeding radiant-electrode from the signal-supply source, the signal is transmitted from the feeding radiant-electrode to the non-feeding radiant electrode by electromagnetic coupling. With such signal supply, the feeding radiant-electrode and the non-feeding radiant electrode perform the antenna actions. Also, according to preferred embodiments of the present invention, the respective open-ends (i.e., capacity-loaded electrodes) of the feeding radiant-electrode and the non-feeding radiant electrode have capacities to the grounded portion of the substrate therebetween, such that the electric current, which is excited by the antenna actions of the feeding radiant-electrode and the non-feeding radiant electrode, flows through the grounded portion. That is, when excited by the antenna actions of the feeding radiant-electrode and the non-feeding radiant electrode, the grounded portion also performs an antenna action corresponding to the antenna actions of the feeding radiant-electrode and the non-feeding radiant electrode.

The grounded portion is provided on a circuit board of a communication apparatus, for example, and the position and size thereof can be varied such that the degree of design freedom is greatly increased. Therefore, even when the size of the feeding radiant-electrode and the non-feeding radiant-electrode is reduced (miniaturized), the transmission and reception of electric waves at a desired frequency bandwidth is performed with sufficient power by appropriately configuring the grounded portion. Moreover, the feeding radiant-electrode and the non-feeding radiant-electrode produce a dual-frequency resonance state, such that the frequency bandwidth is greatly increased as compared with a mono-resonance state where the non-feeding radiant-electrode is not provided.

Furthermore, because the feeding radiant-electrode and the non-feeding radiant-electrode are provided on the dielectric base-substance, the frequency of electric waves radiated from the feeding radiant-electrode and the non-feeding radiant-electrode is increased due to the wavelength reduction effect by the dielectric substance, enabling the size of the feeding radiant-electrode and the non-feeding radiant-electrode to be further reduced.

As described above, with the antenna-electrode structure according to preferred embodiments of the present invention, a simplified antenna-electrode structure having a greatly reduced size and an increased bandwidth is provided.

Although a direct-feeding type or a capacity-feeding type feeding radiant-electrode has outstanding characteristics, when a capacity-feeding type is provided, the feeding radiant-electrode can be provided separately from the feeding electrode, such that the feeding electrode is matched to the feeding radiant-electrode by the position of the feeding electrode, resulting in another advantage that a matching circuit is not required to be interposed between the feeding electrode and the signal-supply source.

When the feeding radiant-electrode and the non-feeding radiant-electrode are directly pattern-formed on the non-grounded portion of the substrate, manufacturing costs are reduced because the chip base-substance mentioned above is not required, and further, the manufacturing is simplified.

When the feeding radiant-electrode and the non-feeding radiant-electrode are arranged in the depositing direction via an insulating member interposing therebetween, the space between the feeding radiant-electrode and the non-feeding radiant-electrode can be more easily changed as compared with the case in which both the feeding radiant-electrode and the non-feeding radiant-electrode are provided on the top surface of the dielectric base-substance, for example, such that the amount of electromagnetic coupling between the feeding radiant-electrode and the non-feeding radiant-electrode is easily controlled. Thereby, the dual-frequency resonance state by the feeding radiant-electrode and the non-feeding radiant-electrode is further ensured.

A communication apparatus including the antenna-electrode structure according to preferred embodiments of the present invention is greatly reduced in size and has greatly increased frequency bandwidth in transmitting and receiving electric waves.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Preferred embodiments according to the present invention will be described below with reference to the drawings.

Figure 11A:
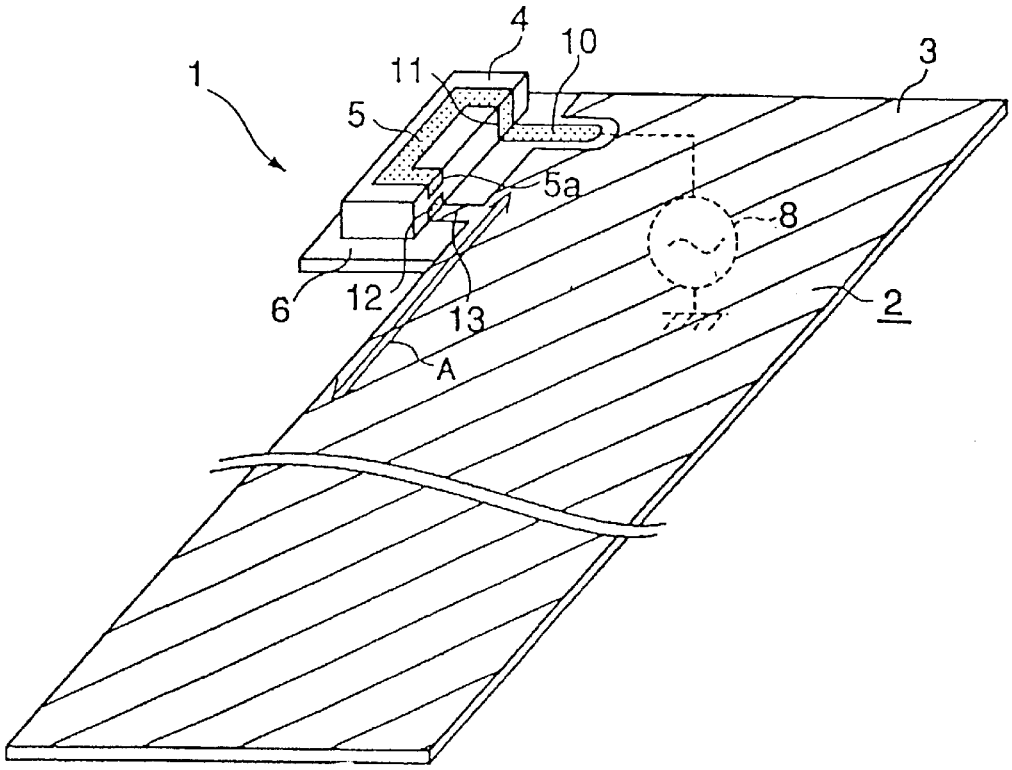
FIGS. 11A and 11B are schematic representations showing an example of the antenna-electrode structure proposed by the inventor.
Figure 11B:
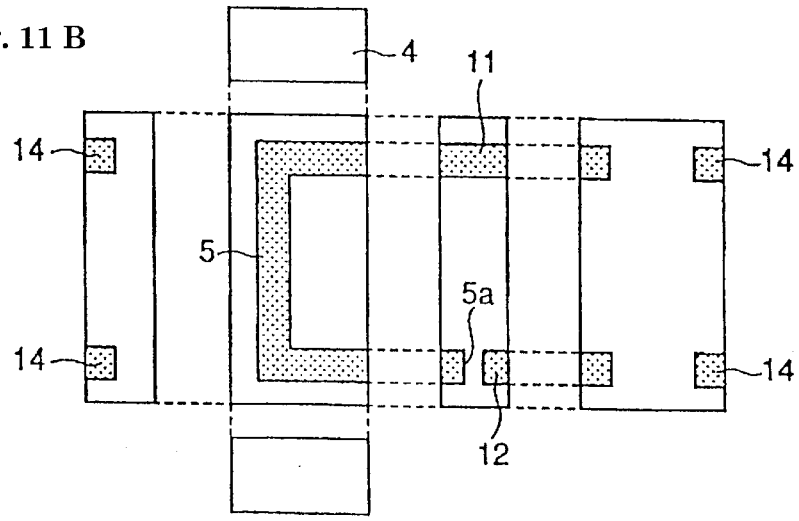

FIG. 11A shows an example of an antenna-electrode structure that is a preliminary step toward the antenna-electrode structure according to preferred embodiments of the present invention. FIG. 11B is a drawing shown in a developed state of a chip base-substance 4 that is a substantially rectangular dielectric base-substance defining the antenna-electrode structure shown in FIG. 11A.

An antenna electrode structure 1 shown in FIGS. 11A and 11B preferably includes a substrate (a circuit board of a communication apparatus, for example) 2, a grounded portion 3 provided on the substrate 2, the chip base-substance 4, and a feeding radiant-electrode 5 provided on the chip base-substance 4.

As shown in FIG. 11A, the substrate 2 is provided with an overhang 6 that is a non-grounded portion (i.e., a region on which the grounded portion 3 is not provided), and the chip base-substance 4 is mounted on the overhang 6. Also, on the non-grounded portion of the substrate 2, a feeding wiring-pattern 10 is provided, which is electrically connected to a signal-supply source 8.

Furthermore, on the chip base-substance 4, a feeding electrode 11 is provided at one end (in the feeding-end side) of the feeding radiant-electrode 5 continuously therewith. When the chip base-substance 4 is mounted in a desired region of the overhang 6, as shown in FIG. 11A, the feeding wiring-pattern 10 on the substrate 2 and the feeding electrode 11 on the chip base-substance 4 are arranged to communicate with each other. The feeding-end of the feeding radiant-electrode 5 is thereby electrically connected to the signal-supply source 8 via the feeding wiring-pattern 10 and the feeding electrode 11.

The other end of the feeding radiant-electrode 5 is an open-end 5*a*, which is arranged close to the grounded portion 3 so as to form a capacitance between the open-end 5*a* of the feeding radiant-electrode 5 and the grounded portion 3. That is, the open-end 5*a* of the feeding radiant-electrode 5 is a capacity-loaded electrode defining a capacitance to the grounded portion 3 therebetween.

In addition, in the example shown in FIGS. 11A and 11B, a grounded electrode 12 is provided on the chip base-substance 4. The grounded electrode 12 is arranged to oppose the open-end 5*a* of the feeding radiant-electrode 5 via a space and is also electrically connected to the grounded portion 3 via a lead electrode-pattern 13 provided on the substrate 2. The capacitance between the open-end 5*a* of the feeding radiant-electrode 5 and the grounded portion 3 is increased by the grounded electrode 12. Numeral 14 in FIG. 11B denotes a fixing electrode, which defines a solder priming-electrode during mounting the chip base-substance 4 on the substrate 2 with solder.

In the antenna-electrode structure 1 shown in FIGS. 11A and 11B, as described above, a capacitance is provided between the open-end 5*a* of the feeding radiant-electrode 5 and the grounded portion 3. Thereby, when a signal is fed to the feeding radiant-electrode 5 so as to perform an antenna action, a current is exited in the grounded portion 3 in accordance with the antenna action of the feeding radiant-electrode 5, as shown in A of FIG. 11A. Therefore, not only the feeding radiant-electrode 5, but also the grounded portion 3 performs the antenna action.

Since the transmission or reception of electric waves is conventionally performed only by the feeding radiant-electrode 5 of the chip base-substance 4, when the chip base-substance 4 is miniaturized to meet the demands, the feeding radiant-electrode 5 also is necessarily miniaturized so that the power of the electric waves radiated from the feeding radiant-electrode 5 is reduced, causing a problem that the satisfactory transmission or reception of electric waves cannot be performed.

In contrast, in the antenna-electrode structure 1 shown in FIGS. 11A and 11B, as described above, not only the feeding radiant-electrode 5, but also the grounded portion 3 performs the antenna action. The grounded portion 3 is provided on a circuit board (substrate) 2 of a communication apparatus, for example, and the position and size of the grounded portion 3 are not restricted such that the degree of design freedom is greatly improved, enabling the grounded portion 3 having a desired size to be provided. Therefore, even when the size of the feeding radiant-electrode 5 is reduced, the transmission and reception of electric waves are performed with sufficient power by the grounded portions 3 and the feeding radiant-electrode 5 by appropriately configuring the grounded portion 3.

However, in such an antenna-electrode structure 1, the frequency bandwidth is not satisfactory and an increased bandwidth is required. Accordingly, the inventor invented an antenna-electrode structure that will be described below.

Figure 1A:
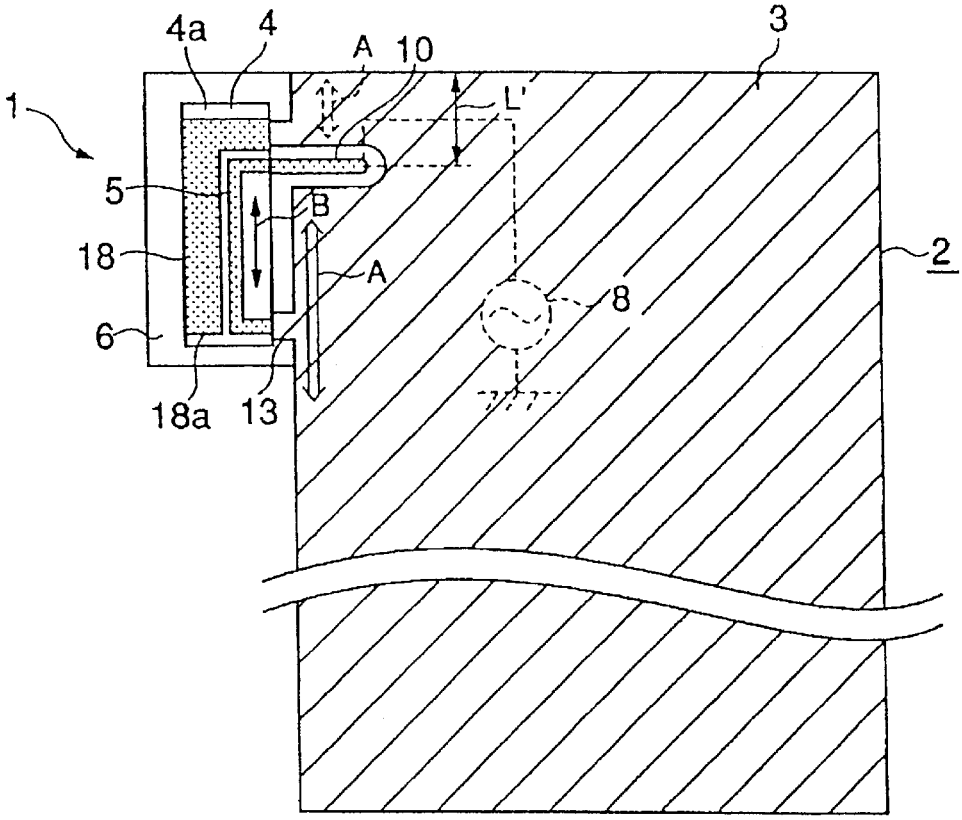
FIGS. 1A and 1B schematic representations showing an antenna-electrode structure according to a first preferred embodiment of the present invention.
Figure 1B:
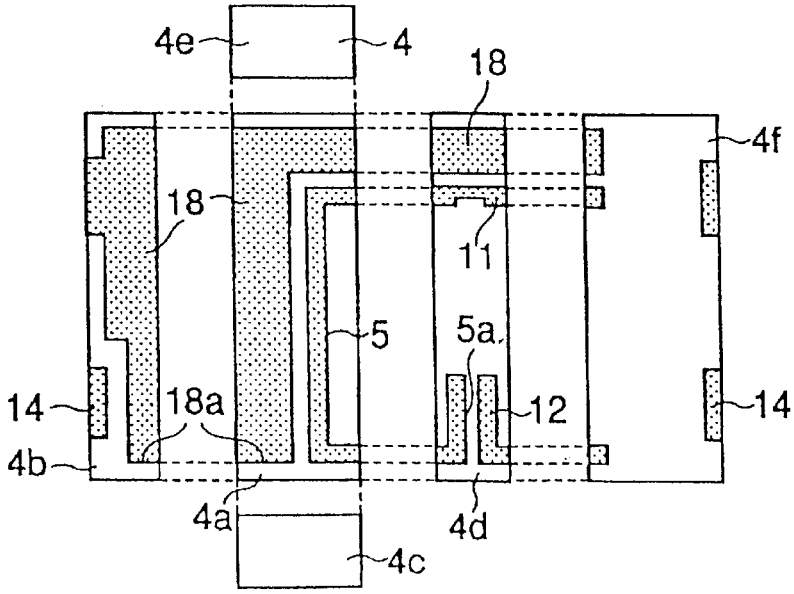

FIG. 1A is a top plan view schematically showing an antenna-electrode structure 1 of a communication apparatus according to a first preferred embodiment. FIG. 1B schematically shows the chip base-substance 4 in a developed state, which defines the antenna-electrode structure 1 shown in FIG. 1A. In addition, the antenna-electrode structure 1, which will be described below, can be provided in various types of communication apparatus, such as a portable telephone, a notebook personal computer with a communication function, and a PDA (Personal Digital Assistant). In the communication apparatus according to the first preferred embodiment, any suitable components may be used other than the antenna-electrode structure 1, which will be described below, such that the description of the components of the communication apparatus other than the antenna-electrode structure 1 is omitted. Also, in the description of the antenna-electrode structure 1, like reference characters designate like functional portions common to those in the antenna-electrode structure 1 shown in FIGS. 11A and 11B, and description thereof is omitted.

In addition to the configuration of the antenna-electrode structure 1 shown in FIGS. 11A and 11B, the characteristic structure in the antenna-electrode structure 1 according to the first preferred embodiment is the arrangement of a non-feeding radiant electrode 18, as shown in FIGS. 1A and 1B.

That is, in the first preferred embodiment, the feeding radiant-electrode 5, as shown in FIG. 1A, is provided on the top surface 4*a* of the chip base-substance 4 and has a substantially U-shape, and the open-end 5*a* of the feeding radiant-electrode 5, as shown in FIG. 1B, extends to a side edge 4*d* of the chip base-substance 4 so as to define the capacity-loaded electrode which provides a capacitance to the grounded portion 3 therebetween, as described above.

The non-feeding radiant-electrode 18 mentioned above, as shown in FIG. 1A, is provided on the top surface 4*a* of the chip base-substance 4 and has a substantially L-shape along the outside of the substantially U-shaped feeding radiant-electrode 5 via a spacing. One end of the non-feeding radiant-electrode 18 extends to the side edge 4*d* of the chip base-substance 4 so as to define a grounded end-portion electrically connected to the grounded portion 3.

The other end of the non-feeding radiant-electrode 18 is an open-end 18*a*. The open-end 18*a* of the non-feeding radiant-electrode 18 is arranged in the vicinity of the open-end 5*a* of the feeding radiant-electrode 5 so as to define a capacity-loaded electrode which provides a capacitance to the grounded portion 3 therebetween. The non-feeding radiant-electrode 18, together with the feeding radiant-electrode 5, is configured to produce return-loss characteristics shown in the solid line $\alpha$ of FIG. 2, i.e., a dual-frequency resonance state. In addition, to produce the dual-frequency resonance state by the feeding radiant-electrode 5 and the non-feeding radiant-electrode 18, various factors, such as an electric field coupling state and magnetic field coupling state of the radiant electrodes 5 and 18 are related. Considering such factors, according to the first preferred embodiment, to produce the dual-frequency resonance state and also to achieve the transmission and reception of electric waves in a desired frequency bandwidth, shapes and sizes (lengths) of the feeding radiant-electrode 5 and the non-feeding radiant-electrode 18, and the space between the feeding radiant-electrode 5 and the non-feeding radiant-electrode 18 are respectively adjusted. There are various design techniques for the feeding radiant-electrode 5 and the non-feeding radiant-electrode 18, and any one of them may be adopted therein such that the description thereof is omitted.

The antenna-electrode structure 1 according to the first preferred embodiment is configured as described above. In the antenna-electrode structure 1 according to the first preferred embodiment, when a signal is supplied to the feeding electrode 11 from the signal-supply source 8 via the feeding wiring-pattern 10, the signal is directly fed to the feeding radiant-electrode 5 from the feeding electrode 11. Also, due to this signal supply, the signal is supplied to the non-feeding radiant-electrode 18 from the feeding radiant-electrode 5 by electromagnetic coupling. Due to such signal supply, the feeding radiant-electrode 5 and the non-feeding radiant-electrode 18 respectively perform an antenna action so as to produce the dual-frequency resonance state.

Furthermore, according to the first preferred embodiment, since the respective open-ends 5*a* and 18*a* of the feeding radiant-electrode 5 and the non-feeding radiant-electrode 18 define capacitances to the grounded portion 3 therebetween, by being exited from each antenna action of the radiant electrodes 5 and 18, an electric current, as shown in A of FIG. 1A, (i.e., a current flowing in a direction connecting the feeding end-portion of the feeding radiant-electrode 5 to the open-end 5*a*, or a current flowing in a direction connecting the grounded end-portion of the radiant electrodes 5 and 18 to the open-end 18*a*) flows from the base end in the vicinity of the feeding end-portion of the feeding radiant-electrode 5. Thereby, the grounded portion 3 performs an antenna action corresponding to those of the radiant electrodes 5 and 18.

Figure 2:
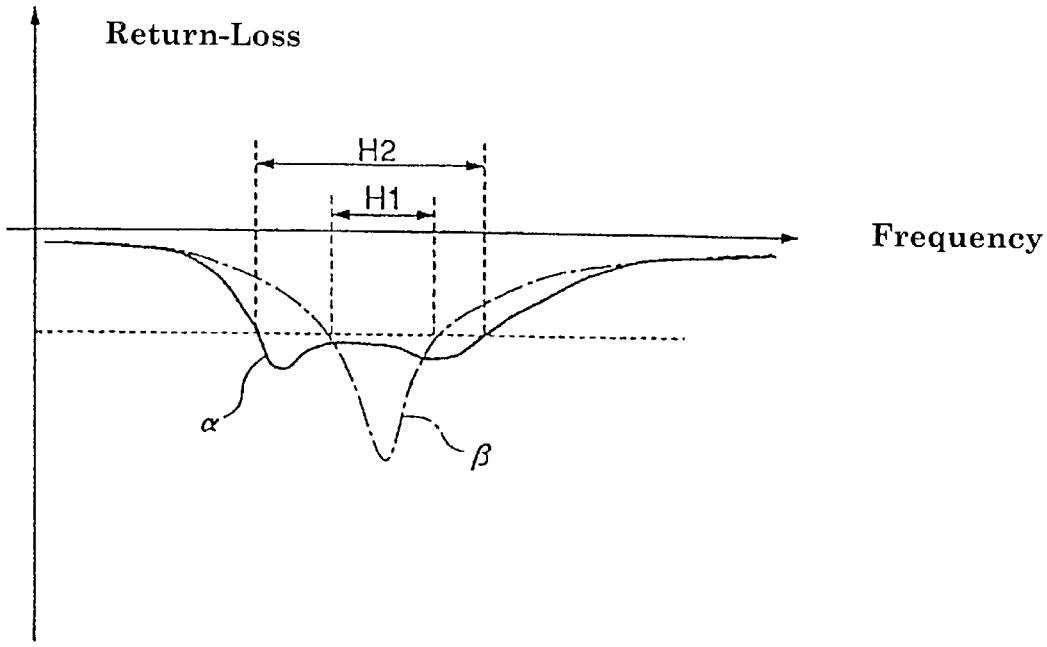
FIG. 2 is a graph for showing an example of return-loss characteristics of the antenna-electrode structure according to the first preferred embodiment of the present invention.

That is, according to the first preferred embodiment, the feeding radiant-electrode 5, the non-feeding radiant-electrode 18, and the grounded portion 3 perform the antenna action having return-loss characteristics in the dual-frequency resonance state, as shown in the solid line α of FIG. 2.

To allow the grounded portion 3 to perform a desired antenna action, the current carrying path length of the excited electric current A, which flows from the base end in the vicinity of the feeding end-portion of the feeding radiant-electrode 5 and is shown in FIG. 1A, is preferably at least greater than the physical length of the antenna. According to the first preferred embodiment, to provide the necessary current-carrying path length, an end region of the longer side of the substrate 2 is provided with the overhang 6 to mount the chip base-substance 4 thereon.

Also, according to the first preferred embodiment, the feeding end-portion of the feeding radiant-electrode 5 is provided at a position as close to a corner region of the grounded portion 3 as possible. The reason is that by being excited from each antenna action of the radiant-electrodes 5 and 18, the grounded portion 3 is provided with not only the electric current A excited therein from a vicinity region of the feeding end-portion of the feeding radiant-electrode 5 as a starting end, but also a current A' produced therein from a vicinity region of the feeding end-portion of the feeding radiant-electrode 5 as a starting end, which is shown by the dotted line A' of FIG. 1A. The current A' has a phase that is offset by 180 degrees from the current A mentioned above. When the current-carrying path length is increased so as to increase the current-carrying amount, the currents A and A' magnetically cancel each other so as to reduce the power of the electric waves. In order to prevent this problem, according to the first preferred embodiment, the feeding end-portion of the feeding radiant-electrode 5 is arranged close to the corner region of the grounded portion 3 so as to reduce the current-carrying path length L' of the current A' and to suppress the current-carrying amount. Thereby, the power reduction of electric waves described above is prevented.

According to the first preferred embodiment, in addition to the configuration of the antenna-electrode structure 1 shown in FIGS. 11A and 11B, the non-feeding radiant-electrode 18 is arranged to produce the dual-frequency resonance state, such that an increased frequency bandwidth is achieved by the dual-frequency resonance state due to the feeding radiant-electrode 5 and the non-feeding radiant-electrode 18, in addition to the outstanding characteristics achieved with the antenna-electrode structure 1 shown in FIGS. 11A and 11B.

This effect is confirmed also by an experiment performed by the inventor. According to the results of the experiment performed by the inventor, in a mono-resonance-type antenna-electrode structure 1, as shown in FIGS. 11A and 11B, return-loss characteristics indicated by the dashed line β of FIG. 2 are shown, and the bandwidth H1 is approximately 90 MHz at 2.5 GHz band. In contrast, in a dual-frequency resonance-type antenna-electrode structure 1 having characteristic configurations according to the first preferred embodiment, as described above, return-loss characteristics indicated by the solid line α of FIG. 2 are shown, and the bandwidth H2 is approximately 170 MHz. Thus, in the antenna-electrode structure 1 according to the first preferred embodiment, the bandwidth is greatly increased as compared with that of the mono-resonance-type one.

Figure 3A:
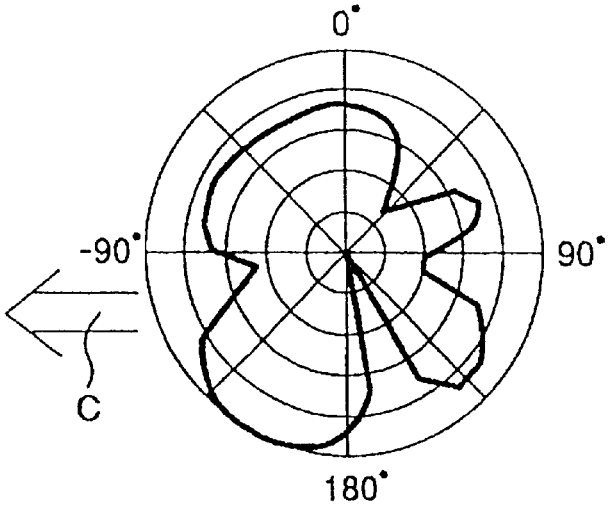
FIGS. 3A and 3B are schematic representations showing an example of electric-waves directivity of the antenna-electrode structure according to the first preferred embodiment of the present invention.

The first preferred embodiment also has an advantage that the directivity control in electric waves is facilitated. That is, according to the first preferred embodiment, since the chip base-substance 4 (the feeding radiant-electrode 5 and the non-feeding radiant-electrode 18) is arranged to protrude in the left side region of the substrate 2 shown in FIG. 3B, the current A excited by each antenna action of the radiant electrodes 5 and 18 is produced in the grounded portion 3 in the left side region shown in FIG. 3B. Because a large amount of electric waves is radiated from a portion having a large amount of the excited current, the first preferred embodiment has a strong directivity of electric waves in the direction indicated by C of FIGS. 3A and 3B as shown in the graph of the directivity of electric waves of FIG. 3A. In addition, FIG. 3A shows the directivity of electric waves on the X-Y plane of FIG. 3B.

Figure 3B:
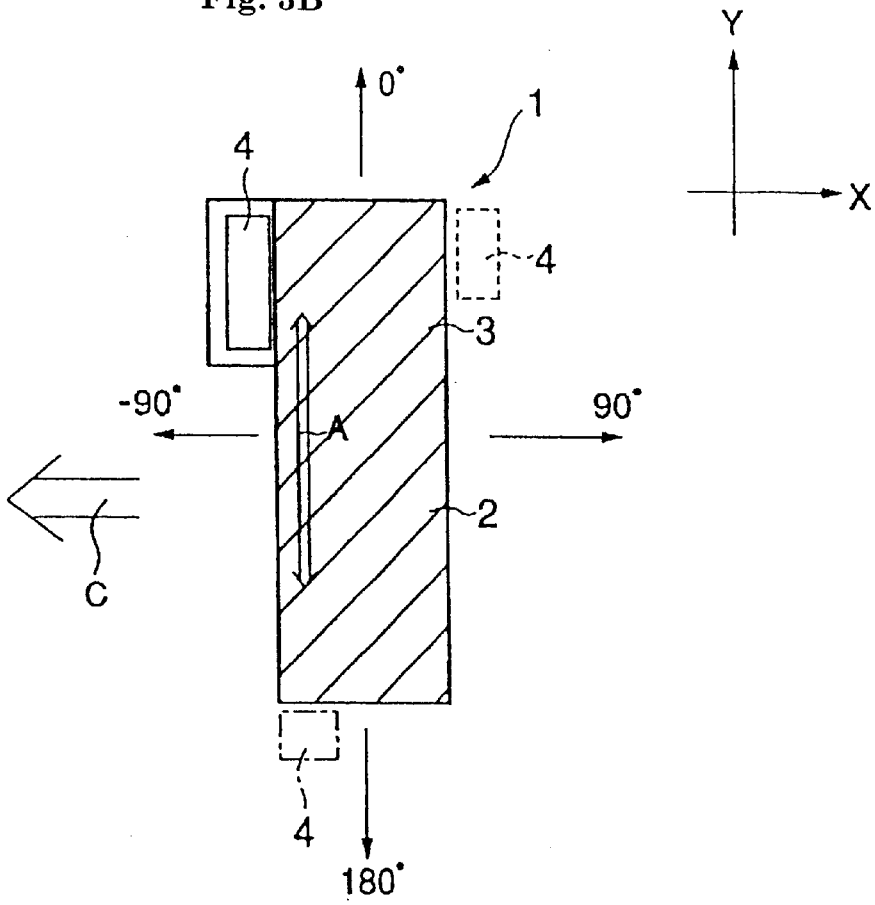

In such a manner, due to the arrangement of the chip base-substance 4 (i.e., the arrangement of the radiant electrodes 5 and 18), the portion having a large amount of the excited current is effectively controlled, thereby effectively controlling the directivity of electric waves. More specifically, when the chip base-substance 4 (the radiant electrodes 5 and 18) is located in the position indicated by the dotted line of FIG. 3B, a strong directivity is provided in a direction of 90° as shown in FIG. 3B. Also, when the chip base-substance 4 (the radiant electrodes 5 and 18) is located in the position indicated by the dash-dotted line of FIG. 3B, a strong directivity is provided in a direction of 180° as shown in FIG. 3B.

Furthermore, according to the first preferred embodiment, since the open-end (i.e., the capacity-loaded electrode) 5*a* of the feeding radiant-electrode 5 and the open-end (the capacity-loaded electrode) 18*a* of the non-feeding radiant-electrode 18 are arranged close to each other, the frequency bandwidth is further increased and greatly improved antenna gains are achieved as compared with the case in which the capacity-loaded electrodes 5*a* and 18*a* of the radiant electrodes 5 and 18 are separated from each other. This advantage is confirmed by the experiment performed by the inventor.

Figure 8A:
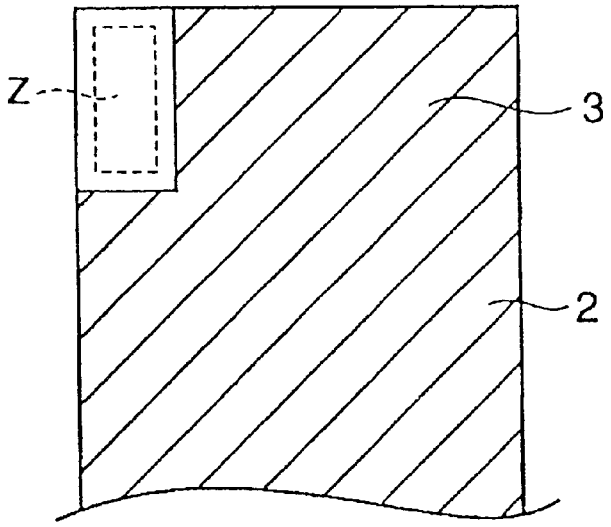
FIGS. 8A and 8B are schematic representations for showing an example of the experiment for obtaining the return loss and the antenna gain in the cases of the close arrangement and the separated arrangement of the feeding radiant-electrode and the non-feeding radiant electrode.
Figure 8B:
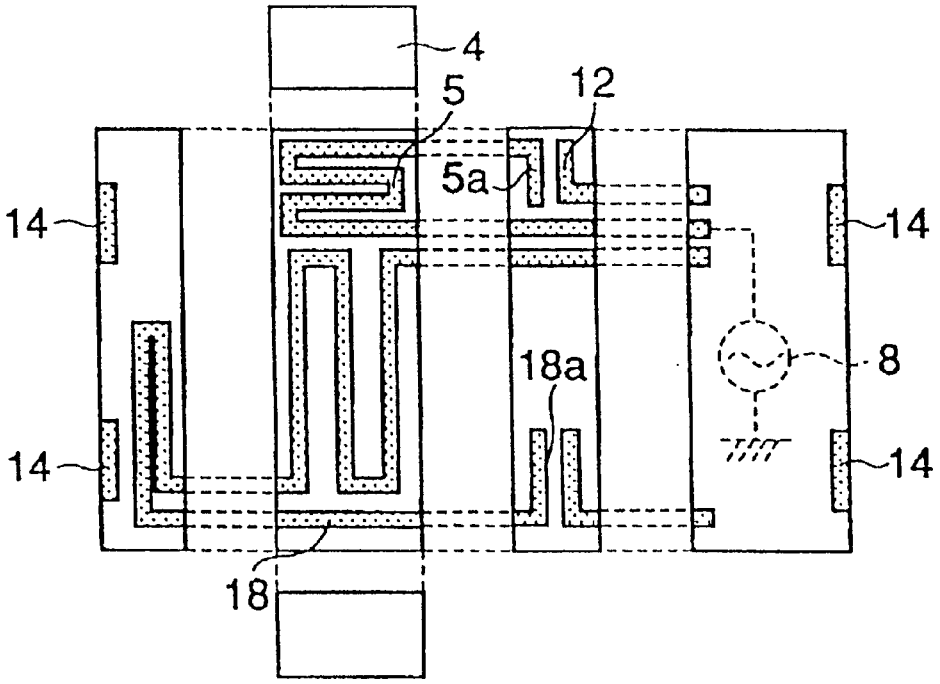
Figure 9A:
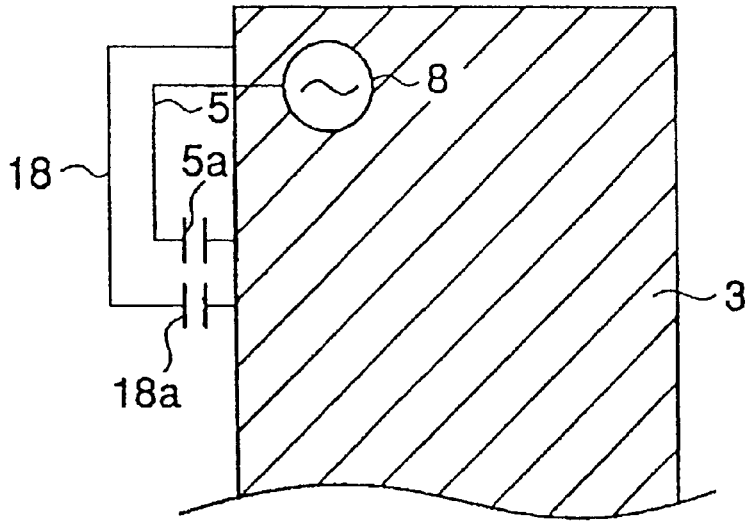
FIGS. 9A and 9B are schematic views showing the cases of the close arrangement and the separated arrangement of the feeding radiant-electrode and the non-feeding radiant electrode.
Figure 9B:
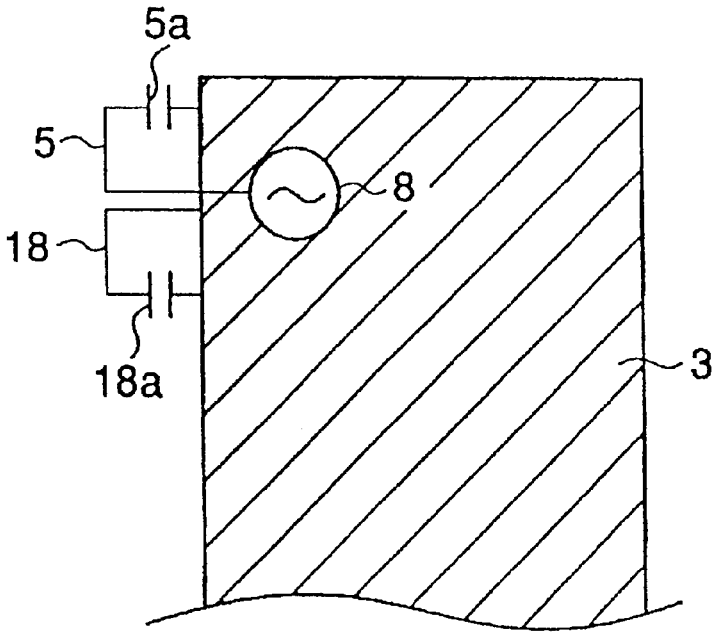

In the experiment, return-loss characteristics and antenna gains are measured for two arrangements, one when mounting the chip base-substance 4 having the feeding radiant-electrode 5 and the non-feeding radiant-electrode 18, which are provided as shown in FIG. 1B, in a dielectric-base-substance mounting region Z of the non-grounded portion shown in FIG. 8A (see the image-drawing of FIG. 9A), and the other when mounting the chip base-substance 4 having the feeding radiant-electrode 5 and the non-feeding radiant-electrode 18, which are provided as shown in FIG. 8B (see the image-drawing of FIG. 9B). In addition, in the experiment, the length of the substrate was about 125 mm and the size of the chip base-substance 4 was about 3 mm×about 12 mm×about 1.8 mm thick.

Figure 10A:
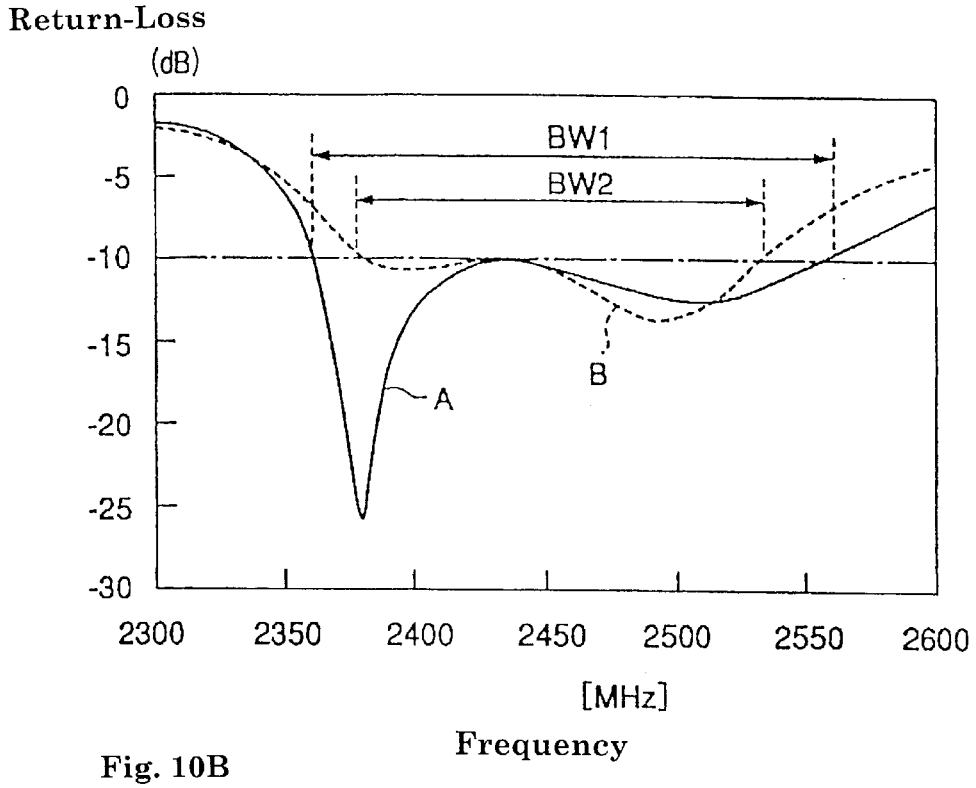
FIGS. 10A and 10B are graphs respectively showing the return loss and the antenna gain in the cases of the close arrangement and the separated arrangement of the feeding radiant-electrode and the non-feeding radiant electrode.
Figure 10B:
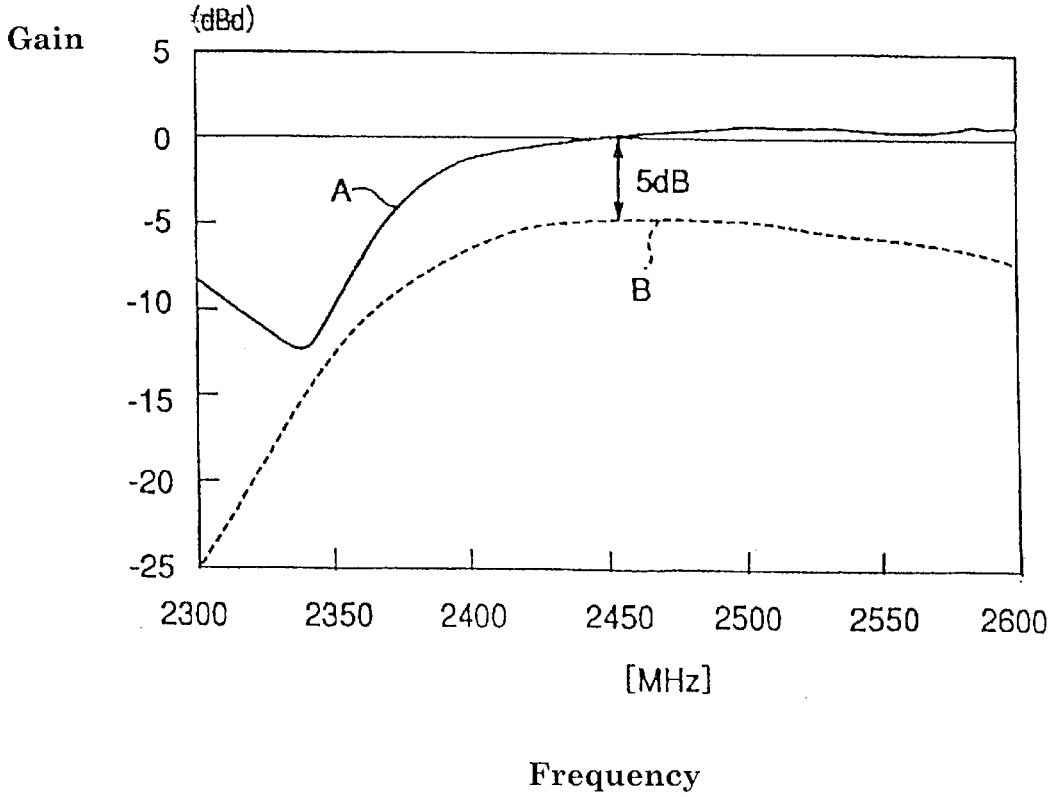

The results of the experiment are shown in graphs of FIGS. 10A and 10B. In these graphs, the solid line A represents the configuration shown in FIG. 1B (i.e., the capacity-loaded electrodes 5*a* and 18*a* of the respective radiant electrodes 5 and 18 are arranged to be close to each other), and the dotted line B which represents the configuration shown in FIG. 8B (i.e., the capacity-loaded electrodes 5*a* and 18*a* of the respective radiant electrodes 5 and 18 are arranged to separate from each other).

As shown in these graphs, the bandwidth is increased by arranging the capacity-loaded electrodes 5*a* and 18*a* to be close to each other, wherein the bandwidth BW2 is approximately 160 MHz when the capacity-loaded electrodes 5*a* and 18*a* of the respective radiant electrodes 5 and 18 are arranged to be spaced from each other whereas the bandwidth BW1 is approximately 200 MHz when the capacity-loaded electrodes 5*a* and 18*a* of the respective radiant electrodes 5 and 18 are arranged to be close to each other. At a frequency of 2450 MHz, the antenna gain when the capacity-loaded electrodes 5*a* and 18*a* are arranged to be close to each other is improved, by approximately 5 dB, than that when the capacity-loaded electrodes 5*a* and 18*a* are arranged to spaced from each other.

By arranging the capacity-loaded electrodes 5*a* and 18*a* to be close to each other, the bandwidth is increased and the antenna gain is improved.

In addition, the respective shapes of the feeding radiant-electrode 5 and the non-feeding radiant-electrode 18 are not limited to those shown in the first preferred embodiment, and various other shapes, such as a meander-shape, may be provided. However, when the respective radiant electrodes 5 and 18 are arranged in parallel with each other along the entire length thereof in the vicinity of the grounded portion 3, the current produced in the radiant electrodes 5 and 18 and the current A excited in the grounded portion 3 magnetically cancel each other because these currents have opposite phases. Thus, according to the first preferred embodiment, although the open-ends 5*a* and 18*a* of the respective radiant electrodes 5 and 18 must be arranged in the vicinity of the grounded portion 3 in order to define a capacitance to the grounded portion 3 therebetween to produce capacity-loaded electrodes, as described above, it is preferable that portions other than those be separated from the grounded portion 3 by as much distance as possible.

Also, according to the first preferred embodiment, the open-end 5*a* of the feeding radiant-electrode 5 is provided on the side edge 4*d* of the chip base-substance 4 while the open-end 18*a* of the non-feeding radiant-electrode 18 is provided on the top surface 4*a* of the chip base-substance 4; however, the positions of the respective open-ends 5*a* and 18*a* are not specifically limited. That is, to appropriately excite a current in the grounded portion 3, capacities between the respective open-ends 5*a* and 18*a* of the radiant electrodes 5 and 18 and the grounded portions 3 must be determined. The appropriate capacities are determined by the arrangement of the respective open-ends 5*a* and 18*a* of the radiant electrodes 5 and 18, such that the arrangement is not limited to that of the first preferred embodiment.

Moreover, according to the first preferred embodiment, the grounded electrode 12 is arranged as shown in FIG. 1B. However, the grounded electrode 12 may be omitted depending on the required capacitance between the open-end 5*a* of the feeding radiant-electrode 5 and the grounded portion 3.

Figure 4A:
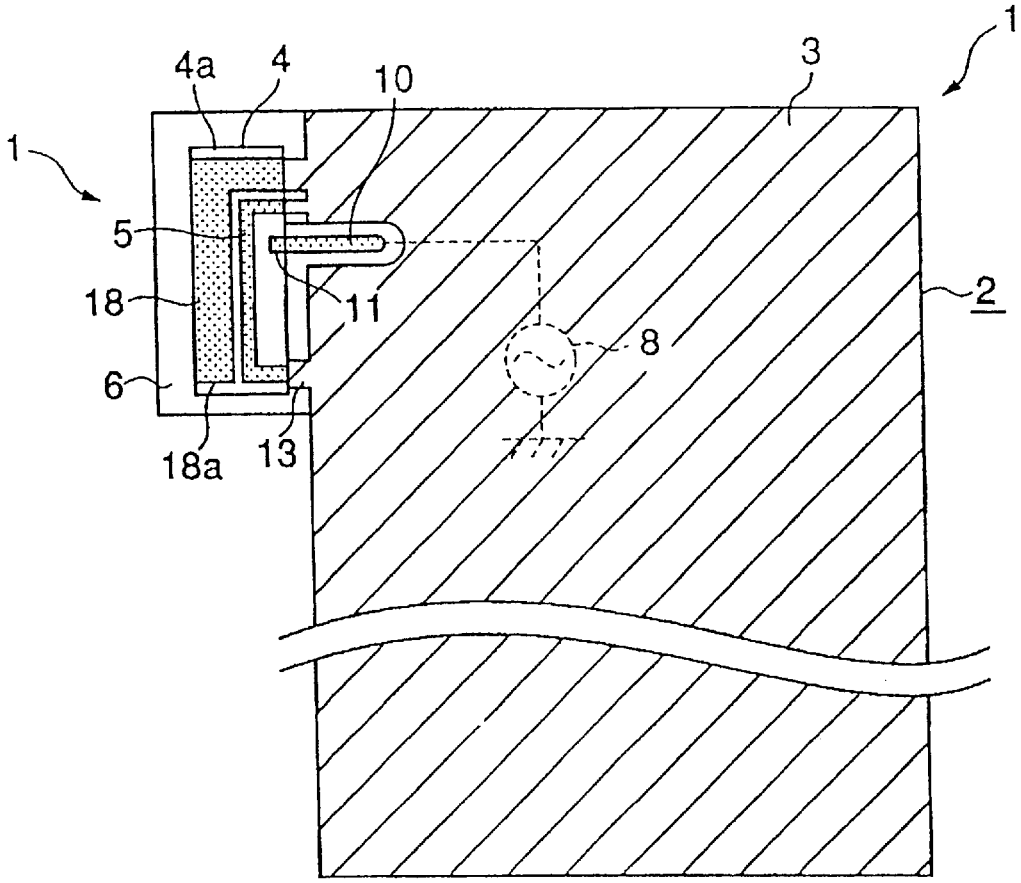
FIGS. 4A and 4B are schematic representations showing an antenna-electrode structure according to a second preferred embodiment of the present invention.
Figure 4B:
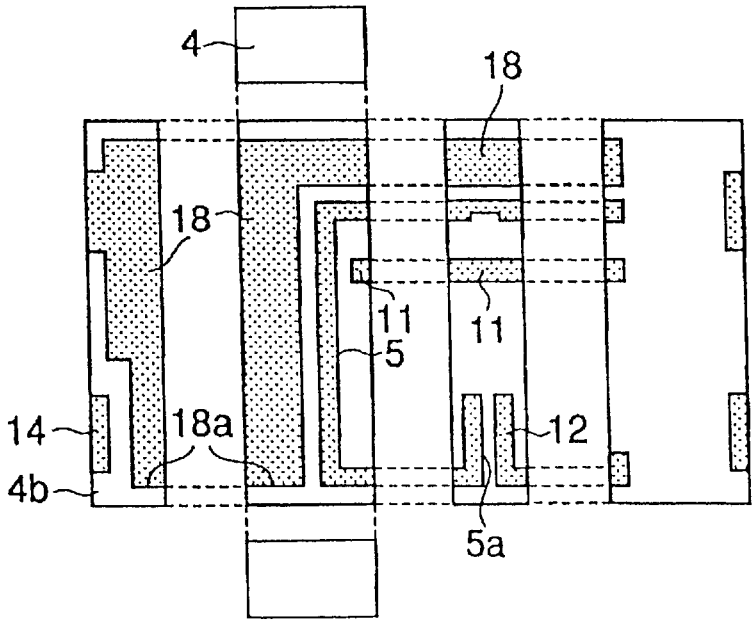

Next, a second preferred embodiment of the present invention will be described below. FIG. 4A is a top plan view schematically showing an antenna-electrode structure 1 according to the second preferred embodiment of the present invention. FIG. 4B schematically shows the chip base-substance 4 in a developed state, which defines the antenna-electrode structure 1. In addition, in the description of the second preferred embodiment, like reference characters designate like elements common to those in the antenna-electrode structure 1 according to the first preferred embodiment, and the description thereof is omitted.

The antenna-electrode structure 1 according to the second preferred embodiment is similar to the antenna-electrode structure 1 according to the first preferred embodiment. However, the feeding radiant-electrode 5 according to the first preferred embodiment is a direct feeding type, whereas in the second preferred embodiment, it is a capacity feeding type.

That is, according to the second preferred embodiment, the feeding electrode 11 electrically connected to the signal-supply source 8 is provided along the feeding radiant-electrode 5 via a spacing therebetween. One end of the feeding radiant-electrode 5, as in the first preferred embodiment, is the open-end 5*a,* which is the capacity-loaded electrode, and the other end is a grounded end, which is electrically connected to the grounded portion 3. The impedance of the feeding radiant-electrode 5 increases from the grounded end thereof toward the open-end. When the impedance of the feeding electrode 11 is about 50 Ω, for example, the feeding electrode 11 is provided at a position opposing a portion of the feeding radiant-electrode 5 having an impedance of about 50 Ω. The feeding radiant-electrode 5 and the feeding electrode 11 are thereby matched to each other.

In such a manner, the feeding electrode 11 is provided at a position of the feeding radiant-electrode 5 via a spacing therebetween where the feeding electrode 11 is matched to the feeding radiant-electrode 5.

The second preferred embodiment, as in the first preferred embodiment, transmits and receives electric waves having sufficient power and has a greatly increased bandwidth even when the size of the radiant electrodes 5 and 18 is reduced. Moreover, since the feeding radiant-electrode 5 is a capacity-feeding type in the second preferred embodiment, the feeding radiant-electrode 5 is matched to the signal-supply source 8 without a matching circuit, resulting in the elimination of the matching circuit.

Figure 5:
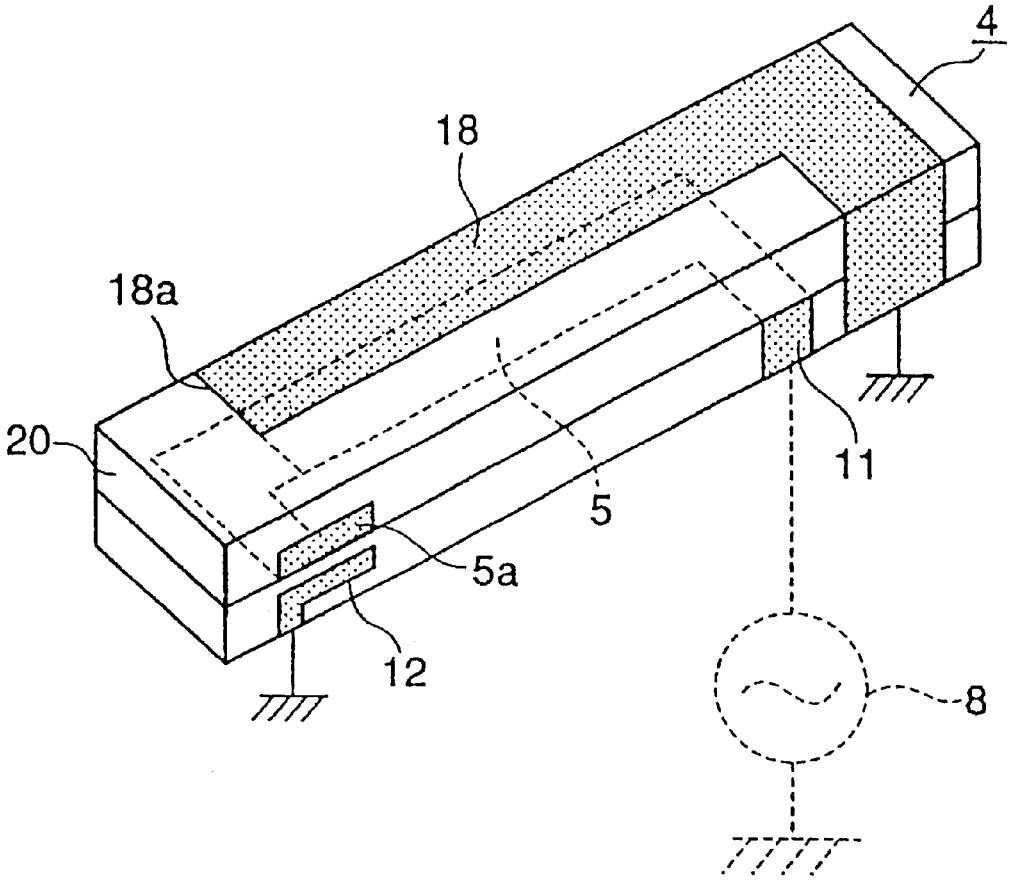
FIG. 5 is a schematic representation showing an antenna-electrode structure according to a third preferred embodiment showing an extracted portion specific to the third preferred embodiment of the present invention.

Next, a third preferred embodiment will be described below. FIG. 5 is a drawing of an antenna-electrode structure according to the third preferred embodiment. According to the third preferred embodiment, as shown in FIG. 5, the feeding radiant-electrode 5 and the non-feeding radiant-electrode 18 are arranged with an insulating member (a dielectric substance, for example) 20 interposed therebetween in a depositing direction. The other features are the same as those in the first and second preferred embodiments described above, such that in the description of the third preferred embodiment, like reference characters designate like elements common to those in the preferred embodiments described above, and description thereof is omitted.

As shown in FIG. 5, in the upper portion of the feeding radiant-electrode 5, the non-feeding radiant-electrode 18 is provided at a position opposing the feeding radiant-electrode 5 with the insulating member 20 provided therebetween. In other words, within the chip base-substance 4, the feeding radiant-electrode 5 is provided. There are various techniques for providing the radiant electrode within the chip base-substance 4, and any one of them may be adopted and the description thereof is omitted.

According to the third preferred embodiment, the radiant electrodes 5 and 18 are arranged such that the feeding radiant-electrode 5 is separated from the grounded portion 3 as compared with the configurations of the first and second preferred embodiments described above. Thereby, the inverse affect of the grounded portion 3 on the feeding radiant-electrode 5 (i.e., the problem that electric waves are deteriorated due to the currents of the feeding radiant-electrode 5 and the grounded portion 3 having opposite phases) is prevented.

The chip base-substance 4 is a dielectric substance and the feeding radiant-electrode 5 is sandwiched between dielectric substances, such that the frequency is increased due to the wavelength reduction effect by the dielectric substance, which enables the size of the chip base-substance 4 to be further reduced.

Moreover, the space between the feeding radiant-electrode 5 and the non-feeding radiant-electrode 18 is greater than that in the first and second preferred embodiments described above, such that the control of electromagnetic coupling between the feeding radiant-electrode 5 and the non-feeding radiant-electrode 18 is greatly improved, enabling the dual-frequency resonance to be further improved.

In addition, in the example shown in FIG. 5, the feeding radiant-electrode 5 is a direct-feeding type; however, it may be of a capacity-feeding type as shown in the second preferred embodiment. Also, in the upper portion of the feeding radiant-electrode 5, the non-feeding radiant-electrode 18 is deposited, in the example shown in FIG. 5; however, the order of the feeding radiant-electrode 5 and the non-feeding radiant-electrode 18 is not limited to the example shown in FIG. 5, and the substrate 2 (the overhang 6), the non-feeding radiant-electrode 18, and the feeding radiant-electrode 5 may be arranged in that order.

Furthermore, the feeding radiant-electrode 5 and the non-feeding radiant-electrode 18 are preferably arranged so as to oppose each other. However, the feeding radiant-electrode 5 and the non-feeding radiant-electrode 18 may be arranged so as not to oppose each other. Also, both the feeding radiant-electrode 5 and the non-feeding radiant-electrode 18 are provided on the chip base-substance 4 in the example shown in FIG. 5. However, for example, one of the feeding radiant-electrode 5 and the non-feeding radiant-electrode 18 may directly pattern-formed on the substrate 2 (the overhang 6), whereas the other may be provided on the top surface of or inside the chip base-substance 4, such that the feeding radiant-electrode 5 and the non-feeding radiant-electrode 18 are arranged by mounting the chip base-substance 4 on the region in which the feeding radiant-electrode 5 or in which the non-feeding radiant-electrode 18 is provided.

Figure 6:
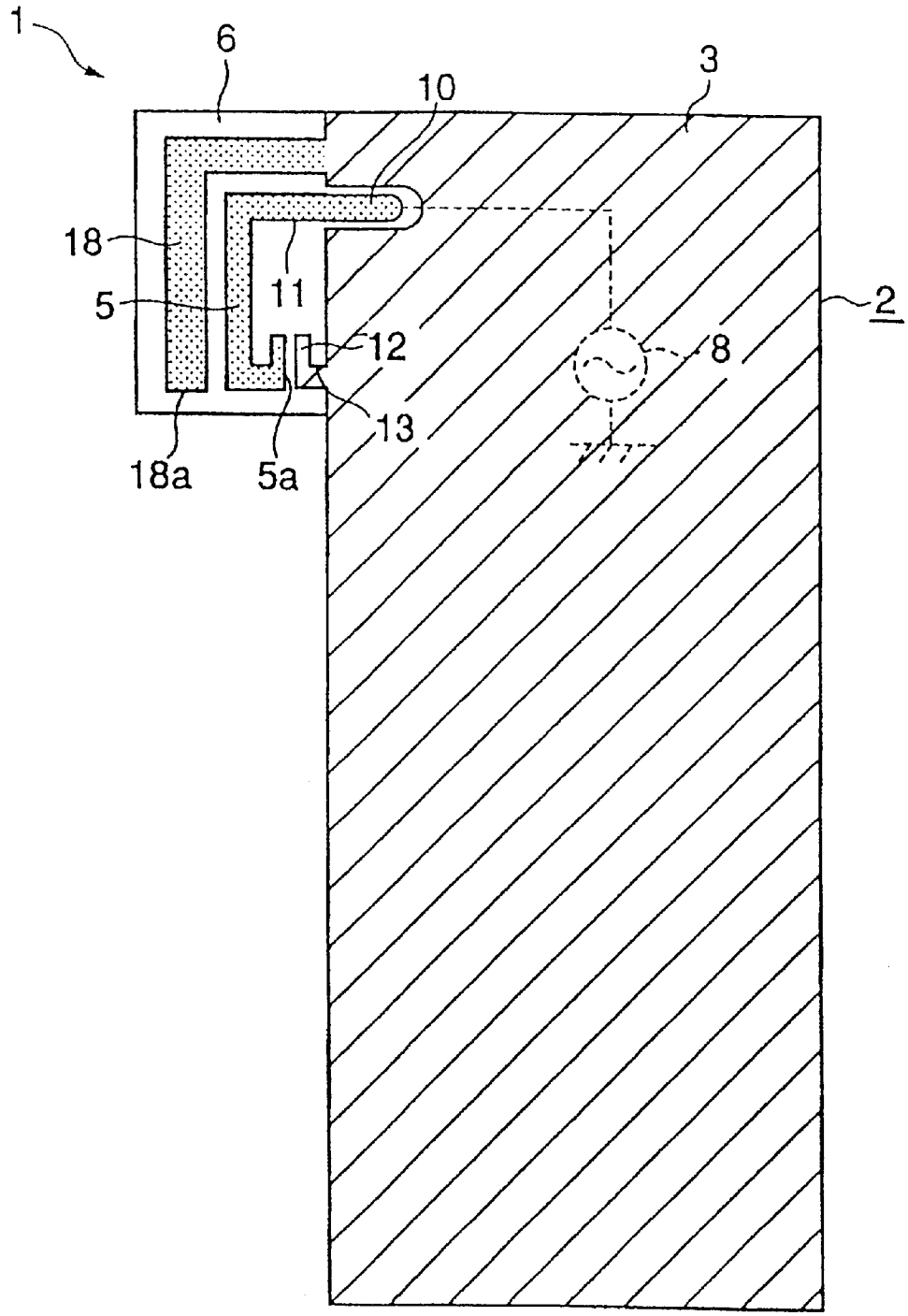
FIG. 6 is a schematic representation showing an antenna-electrode structure according to a fourth preferred embodiment of the present invention.

Next, a fourth preferred embodiment will be described below. According to the fourth preferred embodiment, the feeding radiant-electrode 5, the feeding electrode 11, the grounded electrode 12, and the non-feeding radiant-electrode 18 are not arranged on the chip base-substance 4 as in the previous preferred embodiments described above, but the electrodes 5, 11, 12, and 18 are directly pattern-formed on the overhang 6 which is a non-grounded portion, as shown in FIG. 6. The other features are the same as those in the previous preferred embodiments described above, such that in the description of the fourth preferred embodiment, like reference characters designate like elements common to those in the preferred embodiments described above, and description thereof is omitted.

According to the fourth preferred embodiment, the electrodes 5, 11, 12, and 18 are directly pattern-formed on the non-grounded portion of the substrate 2 (the overhang 6), such that the manufacturing is simplified and the manufacturing costs are greatly reduced.

In addition, in the example shown in FIG. 6, the feeding radiant-electrode 5 is a direct-feeding type; however, it may be a capacity-feeding type as described in the second preferred embodiment.

Figure 7A:
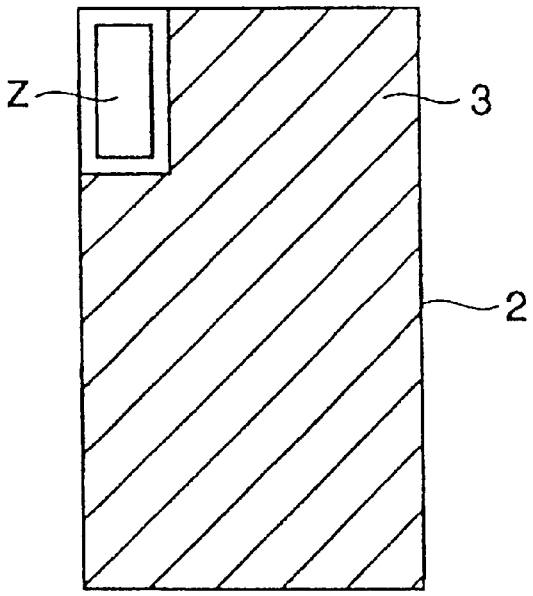
FIGS. 7A and 7B are schematic representations of other arrangement examples of a feeding radiant-electrode and a non-feeding radiant electrode.
Figure 7B:
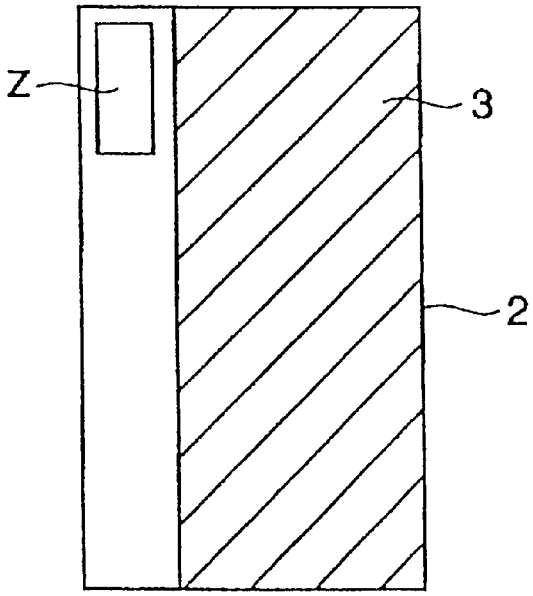

In addition, the present invention is not limited to the preferred embodiments described above, and various modifications may be made. For example, in the preferred embodiments described above, the substrate 2 is preferably provided with the overhang 6 that is the region for providing the feeding radiant-electrode 5 and the non-feeding radiant-electrode 18. However, as shown in FIGS. 7A and 7B, a region Z for providing the radiant electrodes 5 and 18 may be arranged on the substrate 2.

In this case, since the overhang 6 is not arranged to protrude from the substrate 2, damage such as chipping of the overhang 6 when dropped, for example, is prevented, thereby improving the reliability and durability. Also, by eliminating the overhang 6, the degree of design freedom is further increased.

Also, the shape of the grounded portion 3 is not specifically limited and various configurations may be adopted. However, the shape of the grounded portion 3 must have at least a length required for transmitting and receiving electric waves at a desired frequency bandwidth by being excited from each antenna action of the feeding radiant-electrode 5 and the non-feeding radiant-electrode 18.

In the preferred embodiments described above, both of the feeding radiant-electrode 5 and the non-feeding radiant-electrode 18 are provided. However, one of the feeding radiant-electrode 5 and the non-feeding radiant-electrode 18 or a plurality of both electrodes 5 and 18 may be formed, such that each number of electrodes 5 and 18 is not limited. In this case, bandwidth is further increased.

Furthermore, the radiant electrodes 5 and 18 are appropriately arranged in consideration of the path length of the excited current A and the electric-wave directivity of the grounded portion 3, and the arrangement thereof is not limited to the arrangements shown in the preferred embodiments described above.

While preferred embodiments of the invention have been described above, it is to be understood that variations and modifications will be apparent to those skilled in the art without departing the scope and spirit of the invention. The scope of the present invention, therefore, is to be determined solely by the following claims.

What is claimed is:

1. An antenna-electrode structure comprising:

a substrate;

a grounded portion provided on the substrate;

a non-grounded portion on which an antenna is mounted;

a feeding radiant-electrode into which a signal is supplied from a signal supply source;

a non-feeding radiant-electrode arranged adjacent to the feeding radiant electrode in a direction separated from the grounded portion via a space therebetween for producing a dual-frequency resonance state by electromagnetic coupling with the feeding radiant-electrode; and a dielectric base substance surface-mounted on the substrate and having the feeding radiant-electrode mounted thereon; wherein one end of the feeding radiant-electrode is open so as to define a capacitance to the grounded portion therebetween; and wherein the non-feeding radiant-electrode is provided on the dielectric base substance along the feeding radiant-electrode and one end of the non-feeding radiant-electrode is connected to the grounded portion while the other end is open, the open-end of the non-feeding radiant electrode defining a capacity-loaded electrode forming a capacitance to the grounded portion therebetween at a position close to a capacity portion located between the open-end of the feeding radiant-electrode and the grounded portion.

2. An antenna-electrode structure according to claim 1, further comprising an insulating member, wherein the feeding radiant-electrode and the non-feeding radiant-electrode are arranged with the insulating member provided therebetween.

3. An antenna-electrode structure according to claim 1, further comprising a feeding electrode electrically connected to the signal supply source, wherein the feeding radiant-electrode communicates and connects to the feeding electrode so as to define a directly-feeding-type feeding radiant-electrode in which a signal is directly supplied from the signal supply source via the feeding electrode.

4. An antenna-electrode structure according to claim 1, further comprising a feeding electrode electrically connected to the signal supply source, wherein the feeding radiant-electrode is provided in a position spaced from the feeding electrode so as to define a capacity-feeding-type feeding radiant-electrode in which a signal from the signal supply source is supplied by capacity coupling from the feeding electrode.

5. An antenna-electrode structure according to claim 1, wherein the substrate includes an overhang portion and said non-grounded portion is provided on the overhang portion of said substrate.

6. An antenna-electrode structure according to claim 1, wherein said substrate is a chip base-substrate.

7. A communication apparatus according to the present invention comprising an antenna-electrode structure according to claim 1.

8. A communication apparatus according to claim 7, wherein said communication apparatus is a portable telephone.

9. A communication apparatus according to claim 7, wherein said communication apparatus is a notebook personal computer.

10. A communication apparatus according to claim 7, wherein said communication apparatus is a personal digital assistant.

11. An antenna-electrode structure comprising:

a substrate;

a grounded portion provided on the substrate;

a non-grounded portion on which an antenna is mounted;

a feeding radiant-electrode into which a signal is supplied from a signal supply source and having a substantially U-shape;

a non-feeding radiant-electrode arranged adjacent to the feeding radiant electrode in a direction separated from the grounded portion via a space therebetween for producing a dual-frequency resonance state by electromagnetic coupling with the feeding radiant-electrode; wherein one end of the feeding radiant-electrode is open so as to define a capacitance to the grounded portion therebetween; and wherein the non-feeding radiant-electrode is provided on the non-grounded portion along the feeding radiant-electrode and one end of the non-feeding radiant-electrode is connected to the grounded portion while the other end is open, the open-end of the non-feeding radiant electrode defining a capacity-loaded electrode forming a capacitance to the grounded portion therebetween at a position close to a capacity portion located between the open-end of the feeding radiant-electrode and the grounded portion.

12. An antenna-electrode structure according to claim 11, wherein the feeding radiant-electrode and the non-feeding radiant-electrode are directly located and pattern-formed on the non-grounded portion on the substrate.

13. An antenna-electrode structure according to claim 11, further comprising an insulating member, wherein the feeding radiant-electrode and the non-feeding radiant-electrode are arranged with the insulating member provided therebetween.

14. An antenna-electrode structure according to claim 11, further comprising a feeding electrode electrically connected to the signal supply source, wherein the feeding radiant-electrode communicates and connects to the feeding electrode so as to define a directly-feeding-type feeding radiant-electrode in which a signal is directly supplied from the signal supply source via the feeding electrode.

15. An antenna-electrode structure according to claim 11, further comprising a feeding electrode electrically connected to the signal supply source, wherein the feeding radiant-electrode is provided in a position spaced from the feeding electrode so as to define a capacity-feeding-type feeding radiant-electrode in which a signal from the signal supply source is supplied by capacity coupling from the feeding electrode.

16. An antenna-electrode structure according to claim 11, wherein the substrate includes an overhang portion and said non-grounded portion is provided on the overhang portion of said substrate includes.

17. An antenna-electrode structure according to claim 11, wherein said substrate is a chip base-substrate.

18. A communication apparatus according to the present invention comprising an antenna-electrode structure according to claim 11.

19. A communication apparatus according to claim 18, wherein said communication apparatus is a portable telephone.

20. A communication apparatus according to claim 18, wherein said communication apparatus is a notebook personal computer.

21. A communication apparatus according to claim 18, wherein said communication apparatus is a personal digital assistant.

* * * * *